US008740357B1

(12) United States Patent
Dolan et al.

(10) Patent No.: US 8,740,357 B1
(45) Date of Patent: Jun. 3, 2014

(54) METHOD AND STRUCTURE FOR SEALING FINE FLUID FEATURES IN A PRINTING DEVICE

(71) Applicant: Xerox Corporation, Norwalk, CT (US)

(72) Inventors: Bryan R. Dolan, Rochester, NY (US); Mark A. Cellura, Webster, NY (US); Peter J. Nystrom, Webster, NY (US); John P. Meyeres, Rochester, NY (US); Lyle G. Dingman, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/759,982

(22) Filed: Feb. 5, 2013

(51) Int. Cl.
*B41J 2/045* (2006.01)

(52) U.S. Cl.
USPC ..... 347/68

(58) Field of Classification Search
CPC ..... B41J 2/14233; B41J 2/161; B41J 2002/14491; B41J 2/1623; B41J 2002/14419
USPC ..... 347/68
See application file for complete search history.

(56) References Cited

U.S. PATENT DOCUMENTS

| | | | | |
|---|---|---|---|---|
| 6,358,354 | B1 * | 3/2002 | Patil | 156/273.3 |
| 6,502,926 | B2 * | 1/2003 | Cook et al. | 347/63 |
| 6,787,049 | B2 | 9/2004 | Tom et al. | |
| 6,966,630 | B2 | 11/2005 | Sasaki et al. | |
| 7,073,902 | B2 | 7/2006 | Codos et al. | |
| 7,922,860 | B2 | 4/2011 | Yoshizawa et al. | |
| 2002/0063757 | A1 | 5/2002 | Kanda et al. | |
| 2004/0085396 | A1 | 5/2004 | Ahne et al. | |
| 2007/0165076 | A1 | 7/2007 | Imken et al. | |
| 2008/0239022 | A1 | 10/2008 | Andrews et al. | |
| 2009/0190968 | A1 | 7/2009 | Mestha et al. | |
| 2009/0315946 | A1 | 12/2009 | Koseki | |
| 2010/0040829 | A1 | 2/2010 | Lin et al. | |
| 2010/0062570 | A1 | 3/2010 | Test | |
| 2010/0149296 | A1 | 6/2010 | Cornell et al. | |
| 2011/0141206 | A1 | 6/2011 | Cheung et al. | |
| 2011/0304671 | A1 | 12/2011 | Law et al. | |

OTHER PUBLICATIONS

M.B. Saeed et al., "Effects of Monomer Structure and Imidization Degree on Mechanical Properties and Viscoelastic Behavior of Thermoplastic Polyimide Films", European Polymer Journal 42, 2006, pp. 1844-1854.
Zuo et al., Final Office Action dated Sep. 20, 2013, U.S. Appl. No. 13/307,231, filed Nov. 30, 2011, pp. 1-15.
Zuo et al., "Multi-Film Adhesive Design for Interfacial Bonding Printhead Structures", U.S. Appl. No. 13/307,231, filed Nov. 30, 2011.
X. Wen et al., "Liquid Adhesive Application by Contact Printing", U.S. Appl. No. 13/657,095, filed Oct. 22, 2012.

* cited by examiner

*Primary Examiner* — Lisa M Solomon
(74) *Attorney, Agent, or Firm* — MH2 Technology Law Group LLP

(57) ABSTRACT

An ink jet printhead including a substrate such as an ink reservoir or an interposer and a printing device. The printing device can be attached to the substrate with a first adhesive and with a second adhesive that is different than the first adhesive. The second adhesive can be applied to the printing device and to the substrate after attaching the printing device to the substrate with the first adhesive. The second adhesive can seal a gap from an ink channel in the substrate to a location between the printing device and the substrate.

10 Claims, 3 Drawing Sheets

METHOD AND STRUCTURE FOR SEALING FINE FLUID FEATURES IN A PRINTING DEVICE

FIELD OF THE EMBODIMENTS

The present teachings relate to the field of ink jet printing devices and, more particularly, to methods and structures for high density piezoelectric ink jet printheads and a printer including a high density piezoelectric ink jet printhead.

BACKGROUND OF THE EMBODIMENTS

Drop on demand ink jet technology is widely used in the printing industry. Printers using drop on demand ink jet technology can use either thermal ink jet technology or piezoelectric technology. Even though they are more expensive to manufacture than thermal ink jets, piezoelectric ink jets are generally favored as they can use a wider variety of inks.

Piezoelectric ink jet printheads typically include a flexible diaphragm and an array of piezoelectric elements (i.e., transducers or PZT's) attached to the diaphragm. When a voltage is applied to a piezoelectric element, typically through electrical connection with an electrode electrically coupled to a voltage source, the piezoelectric element bends or deflects, causing the diaphragm to flex which expels a quantity of ink from a chamber through a nozzle. The flexing further draws ink into the chamber from a main ink reservoir through an opening to replace the expelled ink.

Ink jet printheads can include a semiconductor die, for example a silicon die, a jet stack subassembly, a printhead subassembly, or another structure as a printing device, which is in fluid communication with the ink reservoir. The printing device is typically attached to the ink reservoir, or to an intervening interposer between the ink reservoir and the printing device, using a B-stage adhesive. Creating a fluid-tight seal between the printing device and the ink reservoir using a low-cost thermoset adhesive can be challenging. Seal failures and defects can include voiding of the adhesive between the printing device and the ink reservoir, thus resulting in a site where ink can leak into an undesired location. Another failure, squeeze-out, can result when the adhesive is forced laterally from between the printing device and the ink reservoir during bonding. Squeeze-out can result in either an ink leak between the printing device and the ink reservoir or an occlusion (blockage) by the adhesive within an opening such as an ink channel that is configured for the passage of ink. Further, proper placement of the adhesive is a concern, particularly with decreasing device dimensions. Also, bond line control (i.e., proper thickness of the adhesive as it is dispensed onto a surface) is a concern, as excessive adhesive contributes to squeeze-out, occluded openings, and adhesive voiding. These adhesive issues can negatively impact the fluid seal and cause the print device to fail through ink port plugging and external leaking. Defects related to adhesive can be more problematic for certain design implementations. For example, fine micro-sized fluidic features in the range of 50 to 100 microns or smaller located at the physical edges of their respective devices can be even more difficult to seal. In this case, obstacles such as lack of available bonding area and high risk of occlusions require new approaches for bonding.

SUMMARY OF THE EMBODIMENTS

The following presents a simplified summary in order to provide a basic understanding of some aspects of one or more embodiments of the present teachings. This summary is not an extensive overview, nor is it intended to identify key or critical elements of the present teachings nor to delineate the scope of the disclosure. Rather, its primary purpose is merely to present one or more concepts in simplified form as a prelude to the detailed description presented later.

In an embodiment of the present teachings, a method for forming an ink jet printhead may include attaching a printing device including at least one fluid path to a substrate with a first adhesive, wherein the substrate comprises an ink channel configured to pass ink through the substrate, the first adhesive comprises a first viscosity and, subsequent to attaching the printing device to the substrate, an air gap remains between the printing device and the substrate. The method may further include further attaching the printing device to the substrate with a second adhesive having a second viscosity higher than the first viscosity, wherein the second adhesive physically contacts the printing device and the substrate and seals the air gap.

In another embodiment of the present teachings, an ink jet printhead can include a substrate comprising an ink channel configured to pass ink through the substrate, a first adhesive that attaches a printing device including at least one fluid path to the substrate, wherein the first adhesive is interposed the printing device and the substrate, and a second adhesive having a chemical composition different than a chemical composition of the first adhesive that further attaches the printing device to the substrate, wherein the second adhesive physically contacts an edge of the printing device and the substrate and seals a gap from the ink channel to a location between the printing device and the substrate.

In another embodiment of the present teachings, an ink jet printer can include at least one ink jet printhead. The ink jet printhead can include a substrate comprising an ink channel configured to pass ink through the substrate, a first adhesive that attaches a printing device including at least one fluid path to the substrate, wherein the first adhesive is interposed the printing device and the substrate, and a second adhesive having a chemical composition different than a chemical composition of the first adhesive that further attaches the printing device to the substrate, wherein the second adhesive physically contacts an edge of the printing device and the substrate and seals a gap from the ink channel to a location between the printing device and the substrate. The ink jet printer can further include a printer housing that encases the at least one printhead.

BRIEF DESCRIPTION OF THE DRAWINGS

The accompanying drawings, which are incorporated in and constitute a part of this specification, illustrate embodiments of the present teachings and together with the description, serve to explain the principles of the disclosure. In the figures.

It should be noted that some details of the FIGS. have been simplified and are drawn to facilitate understanding of the present teachings rather than to maintain strict structural accuracy, detail, and scale.

DESCRIPTION OF THE EMBODIMENTS

Reference will now be made in detail to exemplary embodiments of the present teachings, examples of which are illustrated in the accompanying drawings. Wherever possible, the same reference numbers will be used throughout the drawings to refer to the same or like parts.

As used herein, unless otherwise specified, the word "printer" encompasses any apparatus that performs a print outputting function for any purpose, such as a digital copier, bookmaking machine, facsimile machine, a multi-function machine, electrostatographic device, etc. Unless otherwise specified, the word "polymer" encompasses any one of a broad range of carbon-based compounds formed from long-chain molecules including thermoset polyimides, thermoplastics, resins, polycarbonates, epoxies, and related compounds known to the art. Further, the term "substrate" can encompass a printhead interposer, a printhead ink reservoir, or any printhead surface to which a printing device is attached where the surface has a slot, channel, or orifice for passage for ink through the substrate. Additionally, unless otherwise specified, the term "printing device" may be a semiconductor die, a printhead jet stack subassembly, a printhead subassembly, or any printhead structure that includes at least one micro-sized fluidic path, or a plurality of micro-sized fluidic paths, wherein the plurality of fluidic paths are configured for the flow of ink and/or the ejection of ink, for example the ejection of ink through a nozzle or aperture.

An embodiment of the present teachings may result in a more reliable and higher yield (lower defect) fluid seal between two or more structures in an ink jet printhead. The two or more structures can include a printing device such as a semiconductor die, a jet stack subassembly, or other printhead subassembly, and a printhead substrate such as an ink reservoir or a polymer interposer between the ink reservoir and the printing device. While the description below generally describes the embodiments with reference to a semiconductor die as the printing device, it will be understood that an embodiment of the present teachings can include any printing device.

Figure 1:
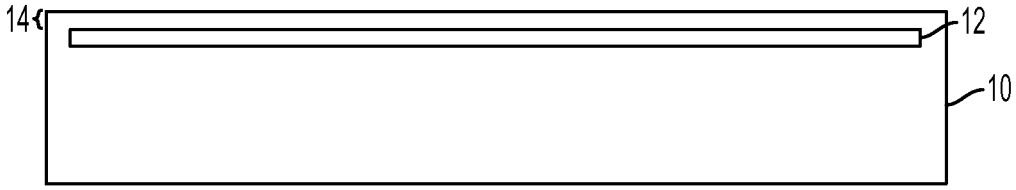
FIGS. 1, 2, 3A, and 4A are plan views.

FIGS. 1-4 are plan views and cross sections of in-process structures which can be formed during an embodiment of the present teachings for physically connecting two or more printhead structures together with a fluid-tight seal. FIG. 1 is a plan view depicting a substrate 10, for example a polymer interposer that may be polyimide, to which an ink reservoir and one or more printing devices can be attached at opposite sides. It will be understood that the structures depicted are exemplary for a particular use of the present teachings, but different structures can be connected together in other embodiments of the present teachings. Further, it will be readily apparent to those of ordinary skill in the art that the FIGS. represent generalized schematic illustrations and that other components may added or existing components may be removed or modified.

The interposer 10 of FIG. 1 includes an ink channel 12 configured to pass ink from an ink reservoir 48 (FIG. 4B) on the opposite side of the interposer 10. The interposer 10 can help align the ink channel 12 of a structure that does not have the appropriate size, location, and geometry of ink channel. The ink channel 12 can be defined in part by a narrow section of material 14 along an edge of the interposer 10.

Figure 2:
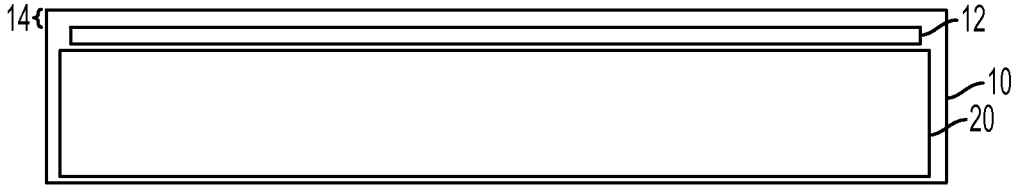

FIG. 2 depicts the FIG. 1 interposer 10 after the application of a patterned first adhesive 20 as a first die bonding step (i.e., a first printing device bonding step), which may be a die bonding epoxy. The die bonding epoxy 20 may be applied using any sufficient technique, such as pad printing, screen printing, etc. In an embodiment, the die bonding epoxy 20 may be, for example, a pad-printable, B-stage, thermally conductive adhesive such as part no. EXP2620-50 available from Creative Materials of Ayer, Mass., or another adhesive. B-stage adhesives are well known. As the adhesive 20 may be exposed to ink such as melted solid ink during printing, the material should be chemically resistant to ink and stable at high temperatures. Further, the adhesive 20 can have a viscosity of between about 2 pascal-second (Pa·s) and about 100 Pa·s, or between about 5 Pa·s and about 50 Pa·s, or between about 8 Pa·s and about 20 Pa·s. At this viscosity, the die bonding adhesive is sufficiently viscous so that it resists flowing into the ink channel 12 while maintaining its suitability for pad printing or screen printing.

A pad printing process for an adhesive is disclosed in application Ser. No. 13/657,095, titled "Liquid Adhesive Application By Contact Printing," filed Oct. 22, 2012, which is incorporated herein in its entirety. In an embodiment using pad printing to apply the die bonding epoxy 20 to an interposer 10 or other substrate, a pad printer passes an ink cup over a chemically etched pattern in a stainless steel plate. The motion of the cup functions as doctor blade to leave epoxy within recesses in the steel plate. The epoxy can be partially gelled after doctoring, and then a pneumatically operated pad contacts the epoxy pattern, lifts the epoxy away from the steel plate, repositions itself over the interposer 10, and stamps the interposer 10 leaving a layer of epoxy 20 approximately 5 μm thick. Multiple stamps of the epoxy may be used to build up the thickness, for example to between about 25 μm and about 50 μm, or another thickness that is suitable to isolate the path defined by the ink channel 12.

In contrast to some conventional processes, the depicted embodiment does not place the adhesive 20 along the narrow section of material 14. Due to its narrow dimensions, placement of adhesive 20 along this section 14 can be difficult. Misplacement of the adhesive 20 can result in adhesive that partially or completely occludes the ink channel 12 and/or insufficient adhesion of a subsequently attached semiconductor die, jet stack subassembly, or other printing device 30 (FIG. 3) to the interposer 10 which can result in leakage of ink between the printing device 30 and the interposer 10. Further, misplacement of the printing device 30 itself may result in an insufficient seal between the narrow section of material 14 and the printing device 30.

Figure 3A:
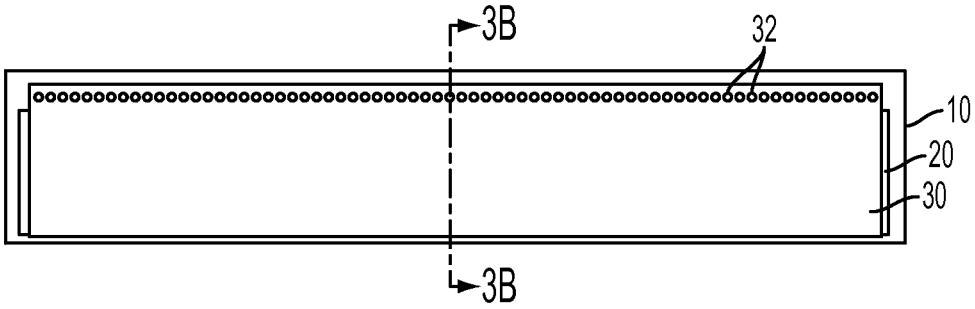
Figure 3B:
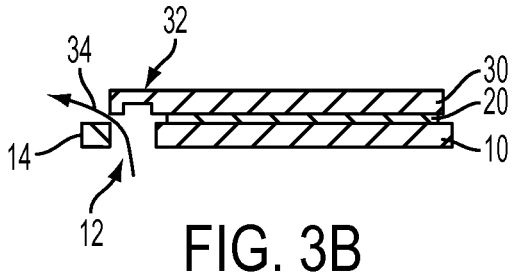
FIGS. 3B and 4B are cross sections, depicting in-process printhead subassemblies that can be formed according to an embodiment of the present teachings.

Next, at least one printing device 30 such as a semiconductor (e.g., silicon) die, jet stack subassembly, or other structure that functions as a printing device during printing is aligned with, and attached to, the interposer 10 using the die bonding epoxy 20 as depicted in the plan view of FIG. 3A and the cross section of FIG. 3B. For simplicity, use of a semiconductor die as a printing device is described herein, but it will be understood that other printing devices may be used instead of, or in addition to, the semiconductor die printing device. After attachment of the semiconductor die 30, the die bonding epoxy 20 may be cured using a technique appropriate for the adhesive 20. The die bonding epoxy 20 serves to mechanically secure the die 30 to the interposer 10, and further fluidically seals and isolates the ink channel 12 at a location beneath the die 30.

The die 30 or other printing device of FIG. 3 includes a plurality of ink inlets 32 as fluid paths (e.g., ink paths), for example one or more rows of inlets each including 96 or more ink inlets. Each row of ink inlets 32 must align with the ink channel 12 in the interposer 10. It will be appreciated that while FIG. 3A depicts the relative location of the ink inlets 32, these features are typically partially etched in die 30 as depicted in FIG. 3B and are not typically visible from the top of the die 30 in the plan view of FIG. 3A. Further, the printing device 30 also typically includes a plurality of ink channels that connect to the ink inlets 32 and route ink across the die 30 to other locations, but the ink channels within the die have not been depicted for simplicity.

Figure 4A:
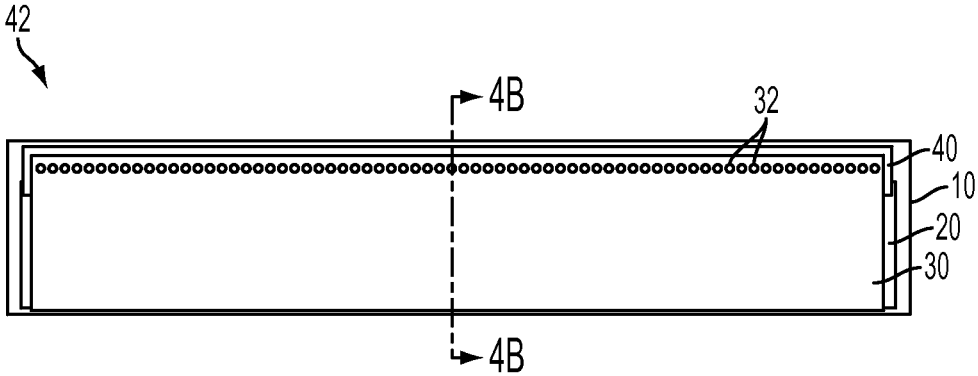
Figure 4B:
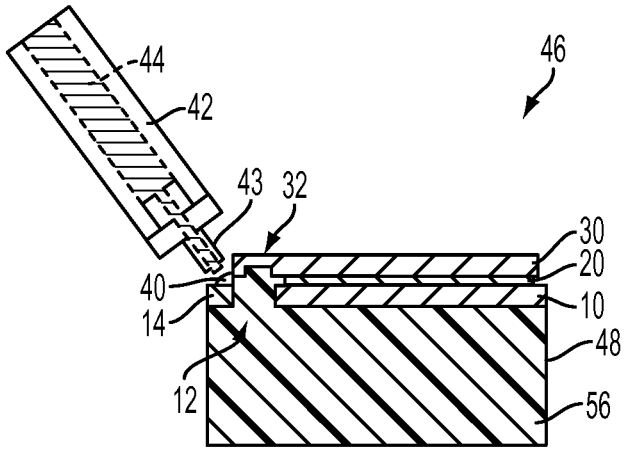

While the die bonding epoxy 20 provides a fluid-tight seal between the die 30 and the interposer 10 at the bonded locations depicted in FIGS. 3A and 3B, at this point in the process there is an air gap or void between the die 30 and the narrow section of material 14 of the interposer 10 that would result in a leakage path 34 between the die 30 and the interposer 10. To seal this gap, a bead of high-viscosity damming encapsulant or adhesive 40 is applied that physically contacts the die 30 and the interposer 10 as depicted in FIGS. 4A and 4B as a second die bonding step. The damming adhesive 40 seals the gap at the edge of the die 30 and the upper surface of the interposer 10 between the die 30 and the interposer 10. The damming adhesive 40 may be applied as an unpatterned die bonding adhesive along the perimeter of the die 30 using, for example, a pressurized syringe 42 and needle dispense tip 43, and then cured using a process appropriate for the adhesive 40. It will be understood that the various structures of the FIGS., including the syringe 42 depicted in FIG. 4B, are depicted for illustration purposes and are not necessarily to scale.

For purposes of this disclosure, the damming adhesive 40 is considered to be an unpatterned adhesive as its shape at the initial contact with the interposer 10 (e.g., part of the adhesive 44 remains in a syringe 42 upon initial contact with the interposer 10 in a syringe-deposition embodiment) is different than its shape at the completion of its application. This is in contrast to the die bonding adhesive 20, which has its final shape upon initial contact with the interposer 10. In an embodiment, the damming adhesive 40 may be Hysol FP4451 available from Henkel Corporation of Rocky Hill, Conn. or another adhesive that has sufficient properties for use as a high-viscosity damming encapsulant. The damming adhesive 40 functions to seal the perimeter at the base of each die 30 in the locations of the ink channel 12. The damming adhesive 40 should thus be chemically resistant to ink and stable at high temperatures. In this step, a higher viscosity material (i.e., higher than the viscosity of the die bonding adhesive 20) is used to minimize wicking of the adhesive 40 beneath each die 30 between each die 30 and the interposer 10. Such wicking has the potential to plug the ink channel 12. In an embodiment, the damming adhesive 40, during application, can have a viscosity of between about 200 Pa·s and about 3000 Pa·s, or between about 500 Pa·s and about 1800 Pa·s, or between about 1000 Pa·s and about 1500 Pa·s. The use of a high viscosity adhesive for the damming adhesive 40 and a lower viscosity adhesive for the die bonding epoxy 20 thus includes a two-step die bonding process, where each adhesive bonds a different location of the die 30. As depicted at the left and right sides of FIG. 4A, the damming adhesive 40 may be applied to overlap the die bonding epoxy 20 at the edges of the die 30 to complete the ink-tight seal. In another embodiment, ends of the damming adhesive 40 can abut and physically contact edges of the die bonding adhesive 20. In yet another embodiment, the damming adhesive 40 may not physically contact the die bonding adhesive 20.

Thus an embodiment of the present teachings can include the use of both a patterned adhesive and a non-patterned adhesive. Where thickness control and patterning are needed beneath the die, a pad printing process, a screen printing process, or another patterned adhesive application process may used to apply a patterned adhesive. In other locations, an application of a non-patterned adhesive, for example using a pressurized syringe deposition, is sufficient to seal a gap between the printing device and the substrate.

The narrow section of material 14 is very close to, and partially defines, the ink channel 12. By applying the second adhesive 40 to the narrow section of material 14 using syringe deposition after initial attachment of the die 30 to the substrate, there is little or no concern for adhesive bond line thickness of the second adhesive 40. Because the die 30 is already partially attached to the substrate 10 upon application of the second adhesive 40, squeeze-out of the second adhesive 40 into the ink channel 12 is not a concern. Any excess second adhesive 40 remains on the narrow section of material 14 and does not encroach into the ink channel 12. Further, the edge of the die 30 can be used as a guide for applying the second adhesive 40. For example, a needle 43 of a depositing syringe 42 can be aligned with the edge of the die 30 during deposition of the second adhesive 40 as depicted in FIG. 4B. Using the edge of the die or other printing device 30 for alignment during placement of an adhesive 40 onto the substrate 10 not possible in processes where a single adhesive layer is used to attach the entire die to the substrate 10. As long as the printing device 30 is properly positioned, the edge of the printing device 30 can be used to align the second adhesive 40 with the narrow section of material 14. This ensures that the second adhesive 40 is properly placed with respect to the printing device 30 and to the narrow section of material 14.

Using two different types of adhesives, for example a first adhesive having a first relatively low viscosity and a first chemical composition and a second adhesive having a second relatively high viscosity (i.e., higher than the viscosity of the first adhesive) and a second chemical composition different than the first chemical composition helps to ensure that the ink channel through the substrate to the printing device is sealed, thus ensuring proper printhead operation during printing. Also, proper fluid flow between the printing device and the substrate allows each piezoelectric actuator of the printing device to be de-primed and pre-tested before committing the assembly to a larger array. This pre-qualification of modules helps to ensure an acceptably high array yield.

Additionally, thermoset adhesives used as the die bonding adhesive 20 are relatively inexpensive compared to other assembly and packaging techniques such as gold brazing. Thermosets may be cured at relatively lower temperatures which enables adhesive curing of a device that contains PZT actuator material, as the low temperatures required for curing avoids depoling of the PZT actuator array. Furthermore, this process may give latitude to designs that would have otherwise been tightly constrained with regard, for example, to the locations available for ink ports. In other words, using a high viscosity adhesive around the ink channels reduces squeeze-out and occlusions caused by adhesive, and still allows the advantages of a B-stage adhesive to physically attach the die to the substrate such as an ink reservoir or interposer.

Once the printhead subassembly 46 of FIG. 4 is completed, the subassembly 42 can be used along with other known printhead subassemblies to form a printhead, for example an ink jet printhead. For illustration purposes, FIG. 4B schematically illustrates an ink reservoir 48 that supplies ink 56 through the ink channel 12 in the interposer 10 and to the ink inlets 32 in the printing device 30.

Figure 5:
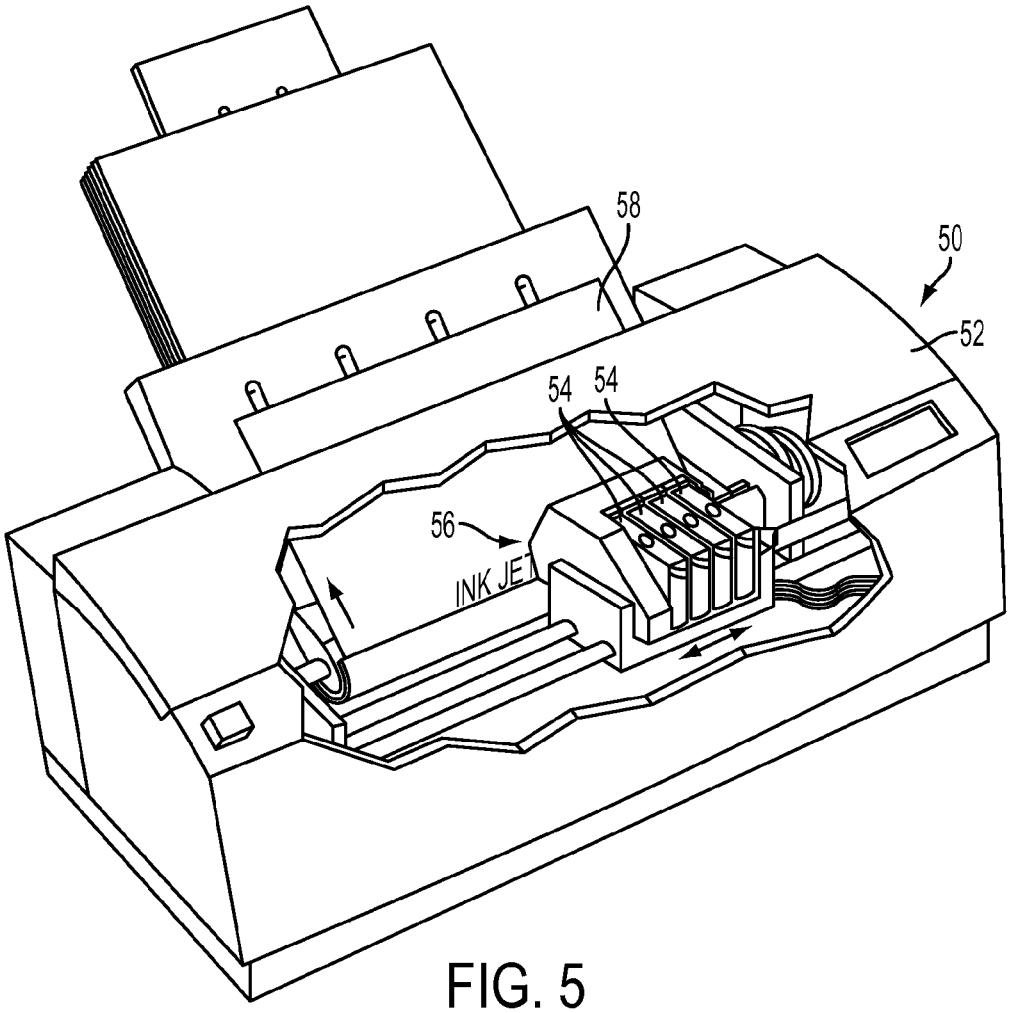
FIG. 5 is a perspective view of a printer including one or more printheads in accordance with an embodiment of the present teachings.

FIG. 5 depicts a printer 50 including a printer housing 52 into which at least one printhead 54 including an embodiment of the present teachings has been installed and that encases the printhead 54. During operation, ink 56 is ejected from one or more printheads 54. The printhead 54 is operated in accordance with digital instructions to create a desired image on a print medium 58 such as a paper sheet, plastic, etc. The printhead 54 may move back and forth relative to the print medium 58 in a scanning motion to generate the printed image swath by swath. Alternately, the printhead 54 may be held fixed and the print medium 58 moved relative to it, creating an image as wide as the printhead 54 in a single pass. The printhead 54 can be narrower than, or as wide as, the print medium 58. In another embodiment, the printhead 54 can print to an intermediate surface such as a rotating drum or belt (not depicted for simplicity) for subsequent transfer to a print medium.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

While the present teachings have been illustrated with respect to one or more implementations, alterations and/or modifications can be made to the illustrated examples without departing from the spirit and scope of the appended claims. For example, it will be appreciated that while the process is described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or embodiments of the present teachings. It will be appreciated that structural components and/or processing stages can be added or existing structural components and/or processing stages can be removed or modified. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, "exemplary" indicates the description is used as an example, rather than implying that it is an ideal. Other embodiments of the present teachings will be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a workpiece, regardless of the orientation of the workpiece. The term "horizontal" or "lateral" as used in this application is defined as a plane parallel to the conventional plane or working surface of a workpiece, regardless of the orientation of the workpiece. The term "vertical" refers to a direction perpendicular to the horizontal. Terms such as "on," "side" (as in "sidewall"), "higher," "lower," "over," "top," and "under" are defined with respect to the conventional plane or working surface being on the top surface of the workpiece, regardless of the orientation of the workpiece.

The invention claimed is:

1. An ink jet printhead, comprising:

a substrate comprising an ink channel configured to pass ink through the substrate;

a first adhesive that attaches a printing device comprising at least one fluid path to the substrate, wherein the first adhesive is interposed the printing device and the substrate; and a second adhesive having a chemical composition different than a chemical composition of the first adhesive that further attaches the printing device to the substrate, wherein the second adhesive physically contacts an edge of the printing device and the substrate and seals a gap from the ink channel to a location between the printing device and the substrate.

2. The ink jet printhead of claim 1, wherein the first adhesive is a B-stage adhesive and the second adhesive is a damming encapsulant.

3. The ink jet printhead of claim 1, wherein the second adhesive overlaps the first adhesive such that a portion of the first adhesive is interposed between the substrate and a portion of the second adhesive.

4. The ink jet printhead of claim 1, wherein the printing device comprises a semiconductor die.

5. The ink jet printhead of claim 1, wherein the printing device comprises a jet stack subassembly.

6. An ink jet printer, comprising:

at least one ink jet printhead, comprising:

a substrate comprising an ink channel configured to pass ink through the substrate;

a first adhesive that attaches a printing device comprising at least one fluid path to the substrate, wherein the first adhesive is interposed the printing device and the substrate; and a second adhesive having a chemical composition different than a chemical composition of the first adhesive that further attaches the printing device to the substrate, wherein the second adhesive physically contacts an edge of the printing device and the substrate and seals a gap from the ink channel to a location between the printing device and the substrate; and a printer housing that encases the at least one printhead.

7. The ink jet printer of claim 6, wherein the first adhesive is a B-stage adhesive and the second adhesive is a damming encapsulant.

8. The ink jet printer of claim 6, wherein the second adhesive overlaps the first adhesive such that a portion of the first adhesive is interposed between the substrate and a portion of the second adhesive.

9. The ink jet printer of claim 6, wherein the printing device comprises a semiconductor die.

10. The ink jet printer of claim 6, wherein the printing device comprises a jet stack subassembly.

* * * * *